US005337905A

United States Patent [19]

Gast

[11] Patent Number: 5,337,905

[45] Date of Patent: Aug. 16, 1994

[54] HANGER ASSEMBLY AND SYSTEM FOR ASSEMBLING A MODULAR CLOSET ORGANIZER IN A CLOSET

[76] Inventor: Arnold E. Gast, 2033 Concourse Dr., St. Louis, Mo. 63146

[21] Appl. No.: 54,614

[22] Filed: Apr. 29, 1993

[51] Int. Cl.[5] ..... A47F 5/00

[52] U.S. Cl. ..... 211/87; 211/90; 211/94; 211/105.3; 248/251

[58] Field of Search ..... 211/87, 90, 94, 104, 211/189, 187, 105.1, 105.3, 123; 248/251

[56] References Cited

U.S. PATENT DOCUMENTS

| | | | |
|---|---|---|---|
| 963,346 | 7/1910 | Wilt . | |
| 1,015,918 | 1/1912 | Walters . | |
| 1,132,190 | 3/1915 | Kohout . | |
| 1,391,495 | 9/1921 | Parsons | 211/94 |
| 2,582,812 | 1/1952 | Wise | 211/94 X |
| 3,124,253 | 3/1964 | Petrich | 211/94 |
| 3,335,872 | 8/1967 | Dodich | 211/86 |
| 3,389,807 | 6/1968 | Manning et al. | 211/94 |
| 3,794,182 | 2/1974 | Royeton | 211/94 |
| 3,981,404 | 9/1976 | Goeke | 211/1.3 |
| 4,427,119 | 1/1984 | Savino | 211/94 |
| 4,611,717 | 9/1986 | Hutson | 248/251 X |
| 4,898,355 | 2/1990 | Steinway | 248/251 X |
| 4,928,833 | 5/1990 | Huizenga | 211/94 X |

OTHER PUBLICATIONS

KV Knape & Vogt, Catalog No. CC828, Knape & Vogt Manufacturing Co., p. 37, Grand Rapids, Michigan, no date, but admitted prior art.

*Primary Examiner*—Robert W. Gibson, Jr.

*Attorney, Agent, or Firm*—Senniger, Powers, Leavitt & Roedel

[57] ABSTRACT

A system for assembling a modular closet organizer into an existing closet for efficient use of the space in the closet includes vertical walls, such as partitions, having at least two sets of holes therein. Adjacent holes in each set of holes have the same predetermined vertical spacing from each other and the sets are horizontally spaced at a predetermined distance. Shelves extend between the vertical partitions and are supported by shelf mounts attached to the partitions. An extensible and retractable hanger assembly for hanging articles such as a garment bag therefrom, may also be mounted on the partition.

11 Claims, 3 Drawing Sheets

HANGER ASSEMBLY AND SYSTEM FOR ASSEMBLING A MODULAR CLOSET ORGANIZER IN A CLOSET

SUMMARY OF THE INVENTION

This invention relates to modular closet organizers in general, and more particularly to an extensible and retractable hanger assembly to be used in conjunction with modular closet organizers.

In the field of closet organizers, there are currently available systems for organizing a closet including vertical walls mounted within an existing closet to divide the closet into a plurality of compartments. Each wall has columns of holes drilled in its outer surfaces at predetermined spacings such that horizontally adjacent holes are aligned. Shelving, supported between two walls by brackets fastened to the holes in the walls, and drawer assemblies may also be installed in the modular closet organizer. Retractable hanging rods, mounted on a wall of the closet organizer may also be provided for hanging garment bags, for example.

Presently, there are many hanging rod kits available for installing a hanging rod on a wall of a closet organizer. One such kit includes horizontally mounting at a desired elevation a reinforcement board which extends substantially the width of the wall. The reinforcement board has openings in registry with the openings in the wall and is fastened to the wall by suitable fasteners, e.g., screw fasteners. The reinforcement board and the wall are preformed with channels in corresponding faces thereof which form a rod-holding bore when the reinforcement board is mounted on the wall. A plate having an opening formed therein of smaller diameter than the diameter of the bore is further provided for receiving a rod. Both ends of the rod have detents for preventing the complete removal of the rod from the opening in the plate. The plate is mounted on the outer edge of the wall such that the opening of the plate is in registry the bore. Pilot holes must be drilled in the outer edge of the wall for receiving fasteners which mount the plate on the wall. Once assembled and mounted, the rod is then movable between a retracted or concealed position in which the rod is received within the bore and an extended position in which the rod extends from the edge of the wall for hanging articles.

Significantly, the above-referenced hanging rod assembly requires boring a hole in the wall and drilling the pilot holes, which in turn is very time-consuming. Such time-consuming steps make closet organizers more expensive.

Although there are hanging rods available which are capable of being mounted on a wall without having to bore a hole in the wall for receiving the rod, such as the valet rods shown in U.S. Pat. Nos. 1,015,918 and 1,132,190, these valet rods are not adapted for installation in a closet organizer where walls of the organizer have predetermined pattern of holes. Thus, their installation would require drilling pilot openings for receiving screw fasteners. Moreover, the valet rods shown in these two patents, along with other prior valet rods known heretofore, have many exposed components (e.g., a rod) which decrease the overall aesthetic appearance of the closet. Also, because these valet rods have many components, they are more difficult to install and more difficult to manufacture.

Accordingly, among the several objects of the present invention may be noted the provision of an improved hanger assembly capable of being installed as a component of a closet organizer without having to pre-drill holes in the organizer; the provision of such a hanger assembly which substantially conceals a hanging rod thereby providing an aesthetically pleasing appearance; the provision of such a hanger assembly which includes only two main components thereby making it easy to install without having to perform any unnecessary and time-consuming steps, such as assembling parts; and the provision of such a hanger assembly which is relatively inexpensive to manufacture. Also among the several objects of the present invention may be noted the provision of a modular closet organizer kit of the type retrofitted into an existing closet for efficient use of the space in the closet; and the provision of such a kit which is easy to install without unnecessary labor expenses, such as pre-drilling holes, for example.

An improved extensible and retractable hanger assembly constructed according to the principles of the present invention is adapted to be mounted on a vertical wall, such as a partition forming part of a closet organizer, for hanging articles such as a garment bag therefrom. The hanger assembly generally comprises a hanger rod having a longitudinal axis. A hook is formed at one end of the rod and a boss projects outwardly from the rod at a location longitudinally spaced from the hook. The boss lies in a plane including the longitudinal axis of the hanger rod which is generally perpendicular to the plane of the hook such that when the hook lies in a substantially vertical plane and opens upwardly for hanging articles thereon, the boss lies in a generally horizontal plane. A mounting sleeve has a rod channel including a bottom, an open slot opposite the bottom and extending the length of the channel and an open mouth generally at one longitudinal end of the rod channel. A guide channel is formed in the bottom of the rod channel and is smaller than the rod channel. The rod channel is adapted to slidably receive the rod with the hook disposed outwardly of the mouth of the rod channel such that the rod may be selectively extended from and retracted into the rod channel through the mouth thereof. The guide channel is adapted to slidably receive the boss and has a stop formed therein engageable with the boss to prevent withdrawal of the hanger rod from the mounting sleeve through the open mouth thereof. The boss is engageable with sides of the guide channel for holding the hanger rod from rotation about its longitudinal axis in the rod channel such that the hook is held in a position in which it opens upwardly for receiving and hanging the article. Flange means extends laterally outwardly from the longitudinal edge of the open slot in the rod channel for engaging the vertical wall. The flange means is adapted to receive fasteners therethrough for mounting on the wall whereby the hanger assembly may be mounted on a flat vertical face of the vertical wall without forming a channel in the vertical face for receiving the hanger rod.

Another aspect of the present invention is of a modular closet organizer kit of the type retrofitted into an existing closet comprising at least two vertical partitions each having at least two sets of holes therein. Adjacent holes in each set of holes have the same predetermined vertical spacing from each other, and the sets are horizontally spaced at a predetermined distance. A plurality of screw fasteners are received in the holes in the vertical partitions. At least one shelf is adapted to extend generally horizontally between the vertical partitions. Each shelf has a width greater than the horizontal spacing between the sets of holes in the vertical partitions. Shelf mounts each have an opening therein for receiving one of said fasteners therethrough and into one of the holes in a respective vertical partition. The shelf mount as secured to the vertical partition by the fastener is arranged for engaging the shelf to support the shelf on the vertical partition. An extensible and retractable hanger assembly for hanging articles such as a garment bag therefrom is further provided. The hanger assembly comprises a hanger rod having a longitudinal axis. A hook is formed at one end of the rod and a boss projects outwardly from the rod at a location longitudinally spaced from the hook. The boss lies in a plane including the longitudinal axis of the hanger rod which is generally perpendicular to the plane of the hook such that when the hook lies in a substantially vertical plane and opens upwardly for hanging articles thereon, the boss lies in a generally horizontal plane. A mounting sleeve has a rod channel including a bottom, an open slot opposite the bottom and extending the length of the channel and an open mouth generally at one longitudinal end of the rod channel. A guide channel is formed in the bottom of the rod channel and is smaller than the rod channel. The rod channel is adapted to slidably receive the rod with the hook disposed outwardly of the mouth of the rod channel such that the rod may be selectively extended from and retracted into the rod channel through the mouth thereof. The guide channel is adapted to slidably receive the boss and has a stop formed therein engageable with the boss to prevent withdrawal of the hanger rod from the mounting sleeve through the open mouth thereof. The boss is engageable with sides of the guide channel for holding the hanger rod from rotation about its longitudinal axis in the rod channel such that the hook is held in a position in which it opens upwardly for receiving and hanging the article. Flanges extend continuously along the longitudinal edges of the slot of the rod channel the entire length of the rod channel. The flanges are constructed for face to face engagement with the vertical face of the wall. Each flange has at least two openings therein having a horizontal spacing equal to the horizontal spacing between the sets of holes in each vertical partition. Corresponding openings of the flanges are generally vertically aligned and have a vertical spacing equal to a multiple of the vertical spacing between adjacent holes in the vertical partition whereby the openings in the flanges are adapted to be aligned with holes in the vertical partition and to receive fasteners therethrough for mounting the mounting sleeve on the vertical partition. The arrangement is such that a closet organizer may be constructed in a closet without having to form holes to connect the shelves and hanger assembly to the vertical partitions.

A third aspect of the present invention is that of a method for assembling a closet organizer in a closet, the closet organizer including at least two vertical partitions, at least one shelf and an extensible and retractable hanger assembly. The method comprises the steps of:

(a) erecting the vertical partitions in the closet at spaced apart locations, each vertical partition having at least two sets of holes therein, adjacent holes in each set of holes having the same predetermined vertical spacing from each other, and the sets being horizontally spaced at a predetermined distance;

(b) securing shelf mounts on the vertical partitions by threading fasteners through the self mounts and into the holes in the vertical partition;

(c) laying the shelf on the shelf mounts such that the shelf extends between and is supported by the vertical partitions;

(d) inserting into a rod channel of a mounting plate of the hanger assembly a hanger rod of the hanger assembly having a longitudinal axis, a hook formed at one end thereof and a boss projecting outwardly from the rod at a location longitudinally spaced from the hook, the boss lying in a plane including the longitudinal axis of the hanger rod which is generally perpendicular to the plane of the hook such that when the hook lies in a substantially vertical plane and opens upwardly for hanging articles thereon, the boss lies in a generally horizontal plane;

(e) positioning a mounting sleeve of the hanger assembly against the one of the vertical partitions such that preformed openings in flanges extending laterally of the mounting sleeve are aligned with the holes in the vertical partition; and (f) threading fasteners through the aligned openings and holes of the flanges and securing the mounting plate to the vertical partition, the vertical partition closing the rod channel for holding the hanger rod from movement laterally out of the rod channel.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
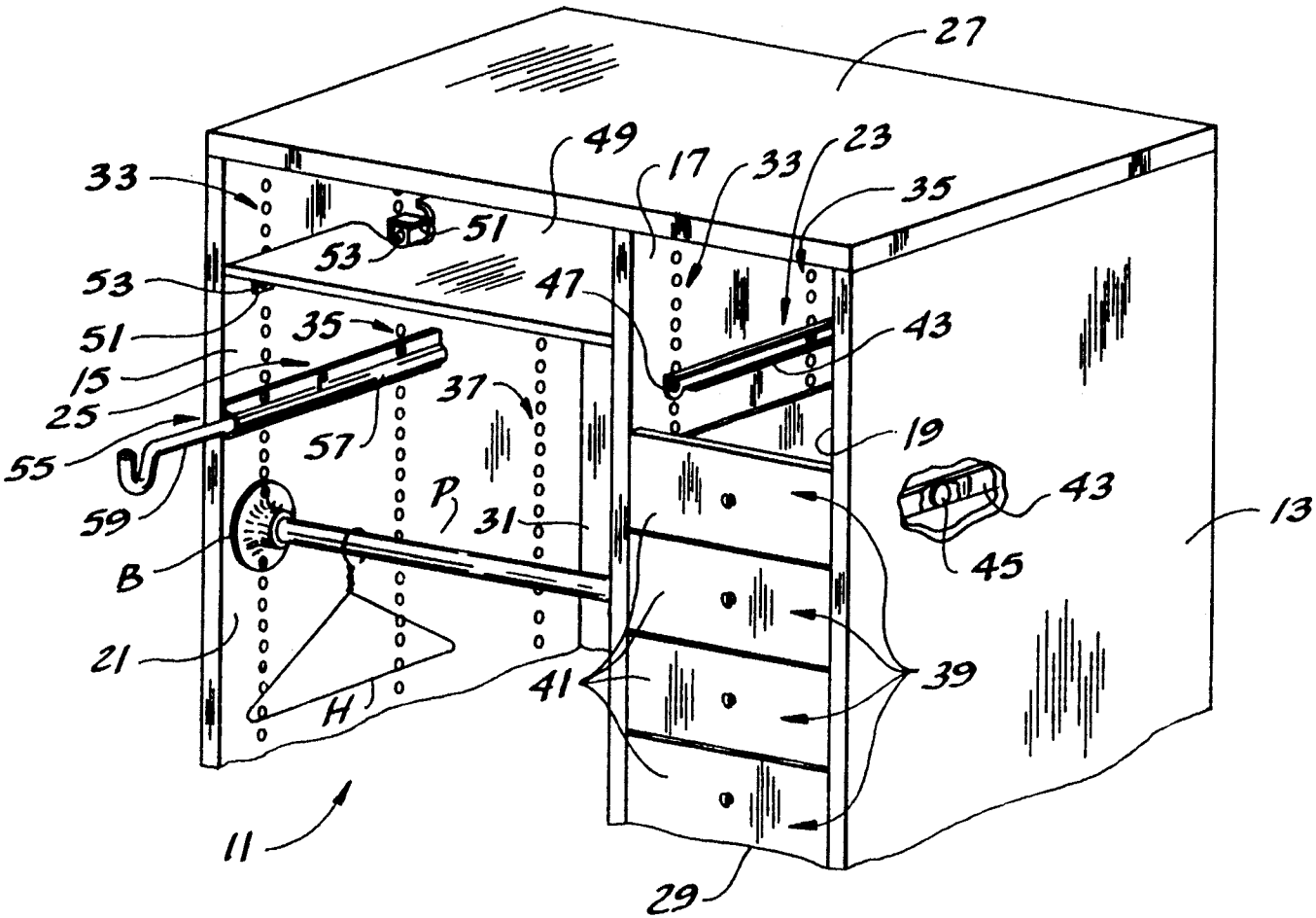
FIG. 1 is a perspective view of a modular closet organizer of the present invention including drawer assemblies, shelving and a hanger assembly therein.

Referring now to the drawings, there is shown a modular closet organizer, indicated generally at 11, of the type retrofitted into an existing closet (not shown) for efficient use of the space of a closet. The modular closet organizer 11 has two laterally outer vertical walls 13 and 15 and a vertical wall, defining a partition 17, located between the first two walls 13 and 15. The partition 17 and walls 13, 15 define two compartments. The walls 13 and 15 and the partition 17 are positioned and aligned such that their front edges define two openings 19 and 21; the right-hand opening 19 accessing a right-hand compartment 23 and the left-hand opening 21 accessing a left-hand compartment 25. The modular closet organizer 11 further includes a top wall 27, a bottom floor 29 and a rear wall 31, which may be positioned against and permanently attached to respective top wall, bottom floor and rear wall of the closet to enclose the sides and rear of the compartments 23 and 25.

Each vertical wall 13, 15, 17 may be made from particle board, for example. However, other materials such as plywood may be used. As shown, three sets or columns of holes, generally designated 33, 35 and 37, from left to right respectively, are provided in the outer surfaces of each wall. These holes are arranged at a predetermined vertical spacing from each other, and the columns are horizontally spaced at a predetermined distance. Such walls are standard in the industry. For example, walls provided by Hettich America, L.P., sold under the registered trademark "System 32", have a first column of holes located from the center of the holes 37 mm (1½") from the front edge of the wall. Each hole is 5 mm (3/16") in diameter and has a depth of 13 mm (33/64"). The vertically spaced holes are spaced apart 32 (1¼") from respective centers. A second column of holes, having the holes at corresponding vertical positions to the holes of the first column are spaced from the first column 190.5 mm (7½"). As shown, a third column of holes may also be provided. It is to be understood that the modular closet organizer of the present invention may include vertical walls having holes spaced at differing intervals and patterns than those described above and still fall within the scope of the present invention.

An example of a closet organizer assembled in one configuration is shown in FIG. 1. However, it is to be understood that the organizer may have other configurations and still fall within the scope of the present invention. As illustrated in FIG. 1, the right-hand compartment 23 of the closet organizer 11 includes a number of stacked drawer assemblies, each designated 39. Each drawer assembly 39 includes a drawer 41 slidable within a pair of oppositely located roller tracks 43 which are adapted to receive rollers 45 (broadly "roller means") mounted on the outer surfaces of the side walls of the drawer 41. Each track 43 has at least two preformed openings therein spaced apart a distance equal to the horizontal spacing between columns of holes in the walls. The openings in the tracks 43 are aligned with preformed holes in the walls to receive screw fasteners 47 therethrough for mounting the tracks on the walls. The drawer assemblies 39 described herein are of standard construction which is well known in the art.

For the left-hand compartment 25 of the closet organizer 11, an adjustable shelf 49 is provided. The shelf 49 has a length sufficient to extend horizontally between the left-hand wall 15 and the vertical partition 17 and a width at least as deep as the distance between two columns of holes (e.g., holes 33 and 35 in wall 15). As illustrated in FIG. 1, however, the shelf 49 extends substantially the depth of the closet organizer 11. It is to be understood that other shelves may be provided in addition to shelf 49. Generally L-shaped shelf mounts 51, each having an opening therein for receiving a screw fastener 53 therethrough and into one of the holes in a respective wall or partition are provided for supporting shelf 49. In the illustrated embodiment, there are six shelf mounts 51 (most of them not shown) fastened for supporting shelf 49 to the wall 15 and partition 17 at a desired elevation. The height of the shelf 49 may be adjusted by moving the shelf mounts 51 to another vertical elevation. Also illustrated in FIG. 1 is a support pole P extending horizontally between the left-hand wall 15 and the vertical partition 17. Two annular brackets B, each having two openings therein for receiving screw fasteners therethrough, are located at opposite ends of the pole P and mounted on the wall 15 and partition 17 by the screw fasteners for supporting the pole P. Hangers H may be hung on the pole P as shown in FIG. 1.

FIG. 1 also illustrates an extensible and retractable hanger assembly of the present invention, generally indicated at 55, for hanging articles, such as a garment bag, therefrom. The hanger assembly 55 may also be used for hanging articles of clothing hung on hangers such as suits, shirts or the like. As shown in FIG. 1, the hanger assembly 55 is mounted on vertical wall 15 at a suitable elevation (i.e., eye level) for hanging articles having a substantial length.

Figure 2:
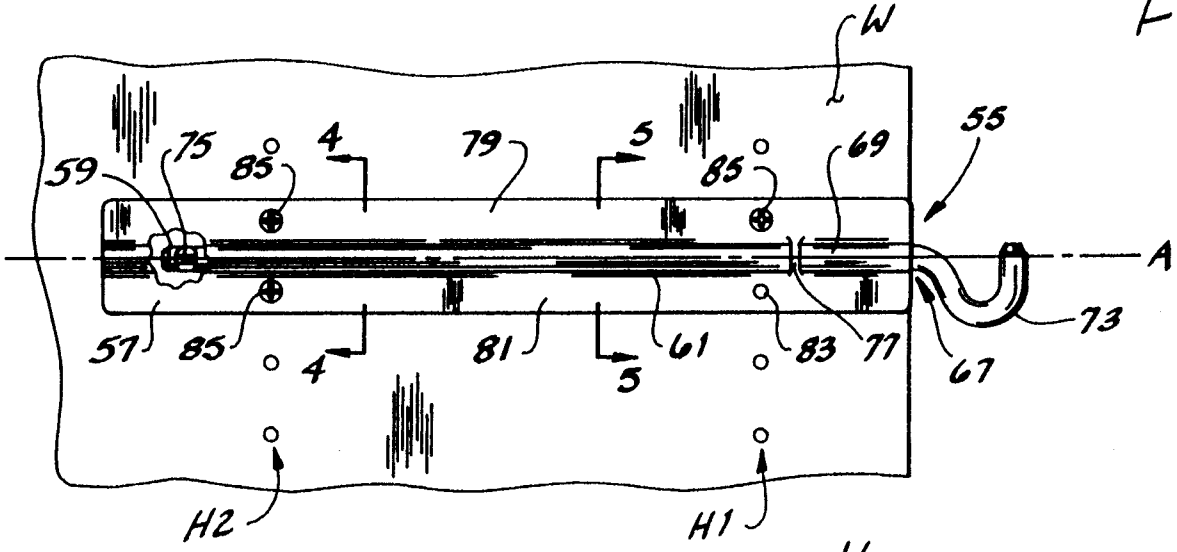
FIG. 2 is a view of the hanger assembly in a retracted position.
Figure 3:
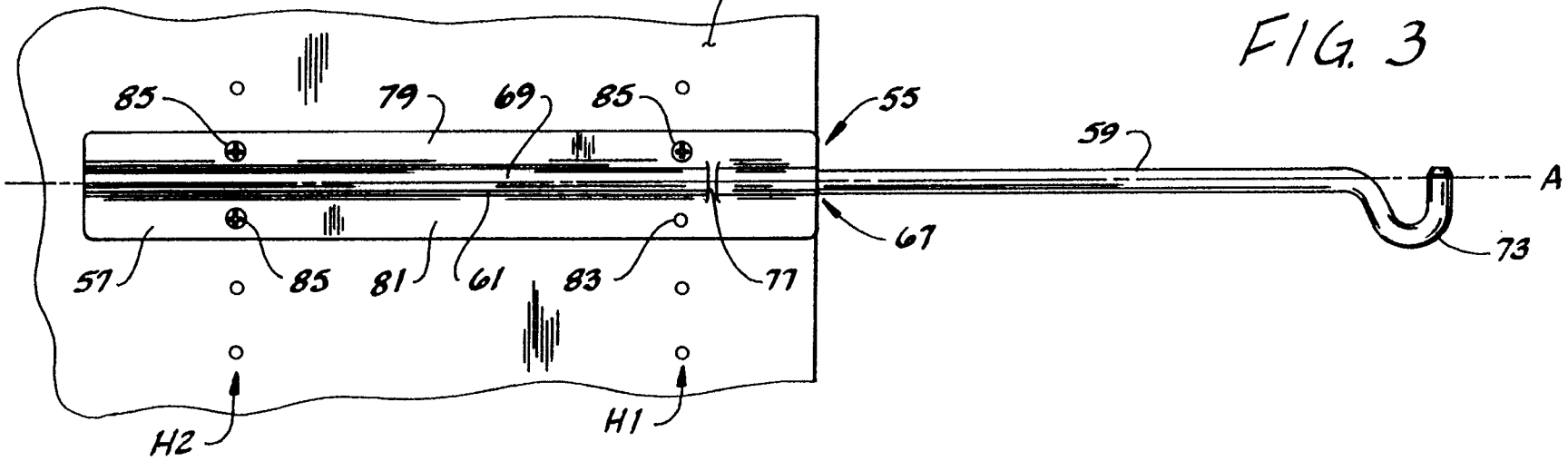
FIG. 3 is a view of the hanger assembly in an extended position.
Figure 5:
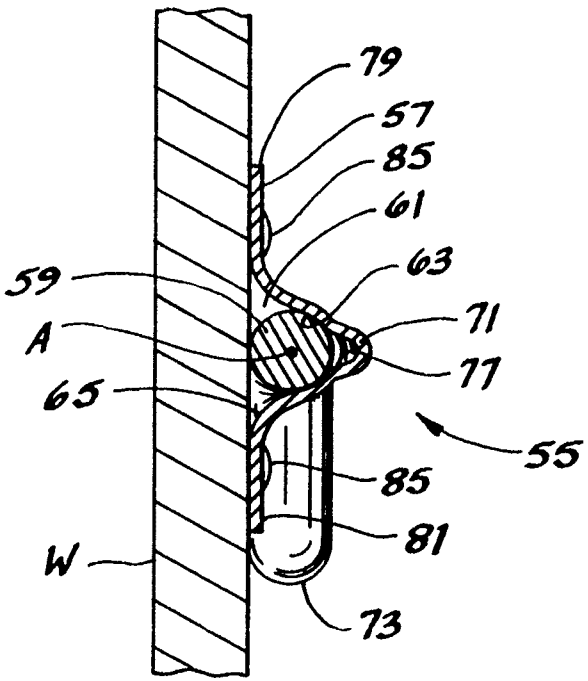
FIG. 5 is a cross-sectional view taken along line 5—5 in FIG. 2.

The hanger assembly 55 includes two primary components; a generally rectangularly-shaped mounting sleeve 57 which is mounted on an exposed surface of a wall and a rod 59 housed by the sleeve 57 and slidable therein between a retracted position (FIG. 2) and an extended position (FIG. 3). The mounting sleeve 57 is preferably made from sheet metal, but could also be formed from other materials such as hard plastic material by an injection molding process. The rod 59 is preferably made from metal stock material.

Turning now to FIGS. 2–5, the sleeve 57 has a rod channel 61 stamped in the sleeve 57 along a longitudinal axis A extending the length of the sleeve 57. The rod channel includes a bottom 63 and an open slot 65 opposite the bottom. The open slot 65 extends the length of the rod channel 61 and terminates at an open mouth 67 at one longitudinal end of the rod channel 61. A guide channel 69 is formed at the bottom 63 of the rod channel 61 and is closed at its bottom 71 opposite its opening into the rod channel. The guide channel 69 is provided for preventing the rotation of the rod 59 relative to the rod channel 61 which will be discussed in greater detail below.

The rod 59, when positioned in the mounting sleeve 57, extends substantially along axis A. An upwardly extending hook 73 is formed at one end of the rod 59 by bending. A boss 75 is provided at the other end of the rod 59 and projects outwardly from the rod. The boss 75 is formed by removing a slot of material from the rod which extends longitudinally along axis A and press-fitting a circular slug in the slot. The boss 75 could also be formed in other ways such as by welding the boss on the rod. The boss 75 lies in a plane including the longitudinal axis A of the rod 59 which is generally perpendicular to the plane of the hook 73. The arrangement is such that when the hook 73 lies in a vertical plane and opens upwardly for hanging articles thereon, the boss 75 lies in a generally horizontal plane.

Figure 4:
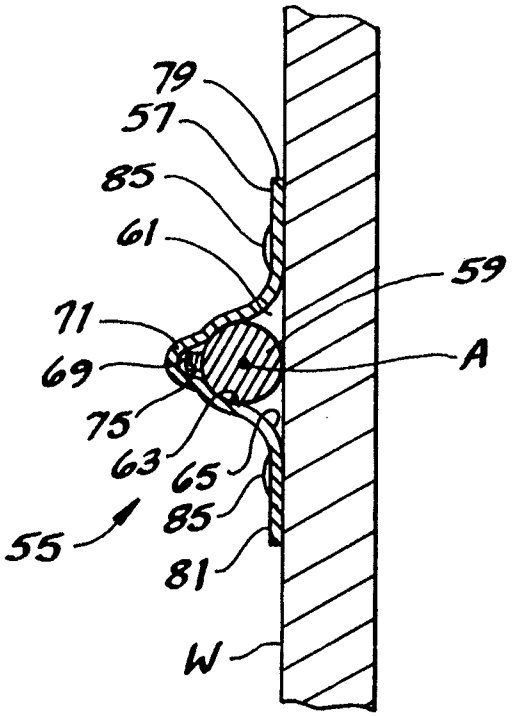
FIG. 4 is a cross-sectional view taken along line 4—4 in FIG. 2.

The rod channel 61 of the mounting sleeve 57 is constructed to receive the rod 59, i.e., the rod channel 61 has a sufficient diameter to receive the rod 59 when mounting the mounting sleeve 57 on a wall. The hook 73 of the rod 59 extends outwardly out of the mouth 67 of the rod channel 61 such that the rod 59 may be selectively extended from and retracted into the rod channel 61 through the mouth 67. Meanwhile, the guide channel 69 slidably receives the boss 75 of the rod 59 for preventing the rotation of the rod 57 relative to the rod channel 61 and thereby maintaining the upward disposition of the hook 73. As best illustrated in FIG. 4, the boss 75 is engageable with the sides of the guide channel 69 for holding the rod 59 from rotating about its longitudinal axis (axis A in the drawings). A crimp 77, defining a stop, is formed in the guide channel 69 generally adjacent to the right-hand side of the guide channel as shown in FIGS. 2 and 3. The crimp 77 projects inwardly into the guide channel 69 and is designed to occupy substantially the entire cross-sectional space of the guide channel 69 (see FIG. 5) for engaging the boss 75. The crimp 77 engages the boss 75 of the rod 59 as the rod is moved to its extended position to prevent the complete withdrawal of the rod from the mounting sleeve 57 through the mouth 67 of the rod channel 61.

Two flanges 79 and 81 (broadly "flange means") extend laterally outwardly from the longitudinal edges of the slot 65 of the rod channel 61 for engaging a wall, e.g., wall W in FIGS. 2–5. The flanges 79 and 81 extend continuously along the longitudinal edges of the slot 65 of the rod channel 61 the entire length of the rod channel. The flanges 79 and 81 are constructed for face-to-face engagement with the vertical face of the wall W. Each flange 79 and 81 includes a pair of clearance openings 83 spaced from one another a distance corresponding to the distance of a pair of horizontally spaced holes provided in the wall W at any elevation. The openings 83 are adapted to be aligned with holes (e.g., holes H1 and H2 in FIGS. 2 and 3) preformed in the wall W and receive screw fasteners 85 therethrough for mounting the mounting sleeve 57 on the wall W with the rod 59 being disposed in the rod channel 61 and the boss 75 being disposed in the guide channel 69 . Thus, the hanger assembly 55 of the present invention may be mounted on the flat vertical face of a wall without having to form a channel in the vertical face of the wall for receiving a rod. The wall W closes the rod channel 61 and holds the rod 59 in the rod channel without preforming an additional channel in the wall. Thus, initial manufacturing costs of the organizer are lower and installation is simpler than heretofore achieved.

In manufacturing the hanger assembly 55, the flanges 79 and 81 and mounting sleeve 57 are preferably made from a sheet metal blank and formed as one piece. The rod channel 61 and guide channel 69 are formed by bending the sheet metal blank in a conventional manner well known in the art. The crimp 77 may be formed in the guide channel 69 by any appropriate means such as by using a stamping tool which is also well known in the art. Similarly, as discussed above, the boss 75 of the rod 59 is formed by removing a slot of material from the rod and press-fitting a slug therein and the hook 73 of the rod may be formed by bending.

All of the components discussed thus far, i.e., the vertical walls, drawers, shelves and garment hanger assembly, may be provided as a kit for installation on site in a closet. When assembling the closet organizer 11, the walls defining the closet organizer, such as the left and right-hand vertical walls 13 and 15, rear wall 31, top wall 27 and flooring 29, if necessary, are first installed. Vertical partitions (e.g., partition 17) may be provided separating the space defined by the laterally outer vertical walls 13 and 15 into separate compartments (e.g., compartments 23 and 25). The walls and partitions are erected in the closet at spaced apart locations suitable to accommodate shelving and drawers having a sufficient width. Each wall and partition has at least two columns of holes on opposing surfaces such that adjacent holes in each column have the same predetermined vertical spacing from each other and each column is aligned with its opposing column on the opposite wall or partition. The foregoing assembly of walls and partitions may be constructed in any suitable fashion.

Individual drawer assemblies 39 may also be installed by mounting the roller tracks 43 on opposing faces of two walls or partitions at a desired elevation. The openings in the two tracks are aligned with holes in the walls or partitions and screw fasteners 47 are received in the openings for securing the tracks. The rollers 45 of a drawer 41 are then slid into and received by the tracks 43, which capture the rollers 45 to allow the back and forth movement of the drawer 41 relative to the walls or partitions.

For shelving, L-shaped shelf mounts 51 are secured on the walls or partitions by screw fasteners 53 threaded through the shelf mounts and into the holes in the respective wall or partition. For the shown embodiment, six shelf mounts 51 are secured to support a shelf 49; three on wall 15 and three on partition 17.

A hanger assembly 55 is installed by inserting a hanger rod 59 into a rod channel 61 of a mounting sleeve 57. The rod 59 is positioned in the rod channel 61 such that a boss 75 of the rod is received in a guide channel 69 of the mounting sleeve 57. The arrangement is such that a hook 73 formed at an end of the rod 59 lies in a substantially vertical plane and opens upwardly for hanging articles thereon. The boss 75 and guide channel 69 prevent the rotation of the rod 59 relative to the mounting sleeve 57 for keeping the hook 73 of the rod upwards.

The mounting sleeve 57, with the rod 59 inserted therein, is positioned against one of the vertical walls or partitions such that the openings 83 in the mounting flanges 79 and 81 are aligned with the holes of the wall or partition. Screw fasteners 85 are then threaded through the aligned openings 83 and holes for securing the mounting sleeve 57 to the wall or partition. In this position, the wall or partition closes the rod channel 61 for holding the hanger rod 59 from movement laterally out of the rod channel 61 and for permitting the axial movement of the rod 59 within the rod channel 61. A crimp 77 in the guide channel 69, engageable with the boss 75 of the rod 59, prohibits the complete withdrawal of the rod 59 from the mounting sleeve 57. Likewise, the hook 73 prohibits the complete insertion of the rod 59 within the rod channel 61 of the mounting sleeve 57.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

What is claimed is:

1. A modular closet organizer kit of the type retrofitted into an existing closet for efficient use of the space in the closet, the closet organizer kit comprising:

at least two vertical partitions each having at least two sets of holes therein, adjacent holes in each set of holes having the same predetermined vertical spacing from each other, and the sets being horizontally spaced at a predetermined distance;

a plurality of screw fasteners adapted to be received in the holes in the vertical partitions;

at least one shelf adapted to extend generally horizontally between the vertical partitions, each shelf having a width greater than the horizontal spacing between the sets of holes in the vertical partitions;

shelf mounts each having an opening therein for receiving one of said fasteners therethrough and into one of the holes in a respective vertical partition, the shelf mount as secured to the vertical partition by the fastener being arranged for engaging the shelf to support the shelf on the vertical partition;

an extensible and retractable hanger assembly for hanging articles such as a garment bag therefrom, the hanger assembly comprising:

a hanger rod having a longitudinal axis, a hook formed at one end thereof and a boss projecting outwardly from the rod at a location longitudinally spaced from the hook, the boss lying in a plane including the longitudinal axis of the hanger rod which is generally perpendicular to the plane of the hook such that when the hook lies in a substantially vertical plane and opens upwardly for hanging articles thereon, the boss lies in a generally horizontal plane; and a mounting sleeve having a rod channel including a bottom, an open slot opposite the bottom and extending the length of the channel and an open mouth generally at one longitudinal end of the rod channel, a guide channel being formed in the bottom of the rod channel, the guide channel being smaller than the rod channel;

the rod channel being adapted to slidably receive the rod with the hook disposed outwardly of the mouth of the rod channel such that the rod may be selectively extended from and retracted into the rod channel through the mouth thereof, the guide channel being adapted to slidably receive the boss and having a stop formed therein engageable with the boss to prevent withdrawal of the hanger rod from the mounting sleeve through the open mouth thereof, the boss being engageable with sides of the guide channel for holding the hanger rod from rotation about its longitudinal axis in the rod channel such that the hook is held in a position in which it opens upwardly for receiving and hanging the article;

flanges extending continuously along the longitudinal edges of the slot of the rod channel the entire length of the rod channel, the flanges being constructed for face to face engagement with the vertical face of the wall, each flange having at least two openings therein having a horizontal spacing equal to the horizontal spacing between the sets of holes in each vertical partition, corresponding openings of the flanges being generally vertically aligned and having a vertical spacing equal to a multiple of the vertical spacing between adjacent holes in the vertical partition whereby the openings in the flanges are adapted to be aligned with holes in the vertical partition and to receive fasteners therethrough for mounting the mounting sleeve on the vertical partition;

such that a closet organizer may be constructed in a closet without having to form holes to connect the shelves and hanger assembly to the vertical partitions.

2. A closet organizer kit as set forth in claim 1 further comprising a drawer assembly including a drawer having roller means mounted thereon, and at least two elongate roller tracks for receiving said roller means therein to permit sliding of said roller means in the tracks, each track having at least two openings therein having a spacing equal to the horizontal spacing between sets of holes in the vertical partitions, the openings in the tracks being adapted to be aligned with holes in the vertical partitions and to receive fasteners therethrough to mount the tracks on the vertical partitions.

3. A closet organizer kit as set forth in claim 1 wherein the mounting sleeve and flange means of the hanger assembly are made from a sheet metal blank and formed as one piece.

4. A closet organizer as set forth in claim 3 wherein the rod channel and guide channel of the mounting sleeve are formed by bending the sheet metal blank, the guide channel opening into the bottom of the rod channel and being closed at its bottom opposite its opening into the rod channel, the stop comprising a crimp in the bottom of the guide channel which projects inwardly into the guide channel for engaging the boss, the boss, crimp and guide channel being sized and constructed so that the hanger rod is held from further movement longitudinally out of the mouth of the rod channel upon engagement of the boss with the crimp.

5. A method for assembling a closet organizer in a closet, the closet organizer including at least two vertical partitions, at least one shelf and an extensible and retractable hanger assembly, the method comprising the steps of:

erecting the vertical partitions in the closet at spaced apart locations, each vertical partition having at least two sets of holes therein, adjacent holes in each set of holes having the same predetermined vertical spacing from each other, and the sets being horizontally spaced at a predetermined distance;

securing shelf mounts on the vertical partitions by threading fasteners through the self mounts and into the holes in the vertical partition;

laying the shelf on the shelf mounts such that the shelf extends between and is supported by the vertical partitions;

inserting into an open rod channel of a mounting sleeve of the hanger assembly a hanger rod of the hanger assembly having a longitudinal axis, a hook formed at one end thereof and a boss projecting outwardly from the rod at a location longitudinally spaced from the hook;

positioning a mounting sleeve of the hanger assembly against the one of the vertical partitions thereby to close the open rod channel and hold the rod in the rod channel, the position of the mounting sleeve being such that preformed openings in flanges extending laterally of the mounting sleeve are aligned with the holes in the vertical partition;

threading fasteners through the aligned openings and holes of the flanges and securing the mounting sleeve to the vertical partition.

6. An extensible and retractable hanger assembly adapted to be mounted on a vertical wall, such as a partition forming part of a closet organizer, for hanging articles such as a garment bag therefrom, the hanger assembly comprising:

a hanger rod having a longitudinal axis and being formed at one end for retaining articles hung on the rod from falling off the rod; and a mounting sleeve having a rod channel including a bottom, an open slot opposite the bottom and extending the length of the channel and an open mouth generally at one longitudinal end of the rod channel, the open slot having sufficient width to admit the hanger rod through the open slot and into the rod channel with said formed end of the rod disposed outwardly of the mouth of the rod channel such that the rod may be selectively extended from and retracted into the rod channel through the mouth thereof;

flange means extending laterally outwardly from the longitudinal edge of the open slot in the rod channel for engaging the vertical wall, said flange means being adapted to receive fasteners therethrough for mounting on the wall whereby the wall closes the open slot of the mounting sleeve for holding the hanger rod from movement laterally out of the rod channel so that the hanger assembly may be mounted on the wall without forming a channel in the wall for receiving the hanger rod.

7. A hanger assembly as set forth in claim 6 wherein the mounting sleeve and flange means are made from a sheet metal blank and formed as one piece.

8. A hanger assembly as set forth in claim 7 wherein said flange means comprises flanges extending continuously along the longitudinal edges of the slot of the rod channel the entire length of the rod channel, the flanges being constructed for face to face engagement with the wall, and having a plurality of openings therein of a predetermined spacing whereby the holes in the flanges are adapted to be aligned with holes preformed in the wall for use in mounting clothes rods, shelves and drawers.

9. A hanger assembly as set forth in claim 8 wherein the hanger rod has a boss projecting outwardly from the rod, and wherein the mounting sleeve has a guide channel formed in the bottom of the rod channel, the guide channel being smaller than the rod channel and adapted to slidably receive the boss, the guide channel having a stop formed therein engageable with the boss to prevent withdrawal of the hanger rod from the mounting sleeve through the open mouth thereof, the boss being engageable with sides of the guide channel for holding the hanger rod from rotation about its longitudinal axis in the rod channel.

10. A hanger assembly as set forth in claim 9 wherein the rod channel and guide channel are formed by bending the sheet metal blank, the guide channel opening into the bottom of the rod channel and being closed at its bottom opposite its opening into the rod channel, the stop comprising a crimp in the bottom of the guide channel which projects inwardly into the guide channel for engaging the boss, the boss, crimp and guide channel being sized and constructed so that the hanger rod is held from further movement longitudinally out of the mouth of the rod channel upon engagement of the boss with the crimp.

11. A hanger assembly as set forth in claim 10 wherein said formed end of the hanger rod is formed in a hook shape, the boss on the hanger rod lying in a plane including the longitudinal axis of the hanger rod which is generally perpendicular to the plane of the hook such that when the hook lies in a substantially vertical plane and opens upwardly for hanging articles thereon, the boss lies in a generally horizontal plane.

* * * * *